US007959482B2

(12) United States Patent
Nakamura et al.

(10) Patent No.: US 7,959,482 B2
(45) Date of Patent: Jun. 14, 2011

(54) MANUFACTURING METHOD FOR IGNITION PLUG INVOLVES REMOVING LEADING END PORTION OF SHELL EXTENDED FROM END SURFACE OF INSULATOR

(75) Inventors: Toru Nakamura, Aichi (JP); Tomoaki Kato, Aichi (JP); Yuichi Yamada, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 315 days.

(21) Appl. No.: 12/399,177

(22) Filed: Mar. 6, 2009

(65) Prior Publication Data

US 2009/0227169 A1 Sep. 10, 2009

(30) Foreign Application Priority Data

Mar. 7, 2008 (JP) ..... P2008-058244

(51) Int. Cl.

| | |
|---|---|
| ***H01T 21/02*** | (2006.01) |
| ***F02M 57/06*** | (2006.01) |
| ***F02B 19/00*** | (2006.01) |
| ***F02P 23/00*** | (2006.01) |

(52) U.S. Cl. ..... 445/7; 313/118; 123/143 B

(58) Field of Classification Search ..... None
See application file for complete search history.

(56) References Cited

U.S. PATENT DOCUMENTS

| | | | | |
|---|---|---|---|---|
| 4,369,756 | A * | 1/1983 | Ezoe | 123/620 |
| 7,659,655 | B2 * | 2/2010 | Tozzi et al. | 313/143 |
| 2007/0221156 | A1 | 9/2007 | Hagiwara et al. | 123/143 |
| 2007/0221157 | A1 | 9/2007 | Hagiwara et al. | 123/143 |

FOREIGN PATENT DOCUMENTS

| | | |
|---|---|---|
| JP | 2007-287666 | 11/2007 |

* cited by examiner

*Primary Examiner* — Toan Ton
*Assistant Examiner* — Britt D Hanley
(74) *Attorney, Agent, or Firm* — Kusner & Jaffe

(57) ABSTRACT

A manufacturing method for an ignition plug is provided. The method includes: preparing an insulator having a cavity provided at a leading end portion thereof by disposing a leading end of the center electrode more inwards than a leading end of the insulator; building the insulator in an interior of the metal shell such that the leading end of the insulator is situated closer to a rear end side than the leading end of the metal shell; removing at least part of a leading end portion of the metal shell which projects from a leading end face of the insulator; and disposing the ground electrode at the leading end portion of the metal shell and welding the ground electrode and the metal shell together after the removal step.

14 Claims, 12 Drawing Sheets

MANUFACTURING METHOD FOR IGNITION PLUG INVOLVES REMOVING LEADING END PORTION OF SHELL EXTENDED FROM END SURFACE OF INSULATOR

FIELD OF THE INVENTION

Apparatuses and devices consistent with the present invention relate to a method for manufacturing an ignition plug.

BACKGROUND OF THE INVENTION

Conventionally, spark plugs which ignite air-fuel mixtures by spark discharge have been used for ignition plugs of engines which are internal combustion engines of automobiles. In recent years, higher power outputs and lower fuel consumptions have been demanded of such internal combustion engines. Because of this, progress has been made in the development of plasma-jet spark plugs that can ignite leaner air-fuel mixtures which burn out quickly and whose ignitable limit air-fuel ratios are higher.

For example, Japanese unexamined patent application publication No. JP-A-2007-287666 describes a related art plasma-jet spark plug. The related art plasma-jet spark plug has a structure in which a cavity, having a small capacity, is formed as a discharge space by surrounding the periphery of a spark discharge gap, between a center electrode and a ground electrode, with an insulator.

The related art plasma-jet spark plug has been manufactured by taking, in general, the following steps (1) to (3). (1) A plate-shaped ground electrode, in which a through hole is formed in a center, is press fit in a ground electrode mounting portion provided at a leading end of a metal shell with a predetermined fitting tolerance. (2) The metal shell and the ground electrode are laser welded together. (3) An insulator, in which a center electrode is built in advance, is held within the metal shell to which the ground electrode has been welded by crimping the insulator to a predetermined engagement portion.

However, in the manufacturing method described above, there was a possibility that the insulator was pressed against the ground electrode with a pressure larger than required when the insulator was made to be held within the metal shell. Therefore, a slight gap was provided between the insulator and the ground electrode, so as to solve the problem. However, in the event that the gap is provided between the insulator and the ground electrode, the energy held by plasma leaks into the gap, leading to a concern that ignitability is reduced.

SUMMARY OF THE INVENTION

Accordingly, it is an aspect of the present invention to provide a manufacturing method of an ignition plug which can eliminate a gap between an insulator and a ground electrode.

Exemplary embodiments of the present invention address the above disadvantages and other disadvantages nor described above. However, the present invention is not required to overcome the disadvantages described above, and thus, an exemplary embodiment of the present invention may not overcome any of the problems described above.

According to one aspect of the present invention, there is provided a manufacturing method for an ignition plug comprising an insulator having an axial hole and a center electrode provided in the axial hole, a substantially cylindrical metal shell and a plate-shaped ground electrode having a through hole formed in a center thereof, the manufacturing method comprising: a preparation step of preparing an insulator having a cavity provided at a leading end portion thereof by disposing a leading end of the center electrode more inwards than a leading end of the insulator; a build-in step of building (i.e., assembling) the insulator in an interior of the metal shell such that the leading end of the insulator is situated closer to a rear end side than the leading end of the metal shell (i.e., the leading end of the insulator is recessed from the leading end of the metal shell); a removal step of removing at least part of a leading end portion of the metal shell which projects from a leading end face of the insulator; and a welding step of disposing the ground electrode at the leading end portion of the metal shell and welding the ground electrode and the metal shell together after the removal step.

According to the manufacturing method described above, at least part of the leading end portion of the metal shell which projects from the leading end face of the insulator is removed, and thereafter, the ground electrode is welded to the leading end portion of the metal shelf. Because of this, it becomes possible to manufacture the ignition plug in which the gap between the insulator and the ground electrode is eliminated.

BRIEF DESCRIPTION OF THE DRAWINGS

Illustrative aspects of the present invention will be described in detail with reference to the following figures wherein.

DETAILED DESCRIPTION OF THE INVENTION

Hereinafter, manufacturing methods of ignition plugs as exemplary embodiments of the present invention and the structures of ignition plugs that are manufactured by the manufacturing method will be described. As a matter of conveniences in the description thereof, firstly, a specific structure of an ignition plug will be described by reference to the drawings. The exemplary embodiments relate to an ignition plug such as a plasma-jet spark plug.

Figure 1:
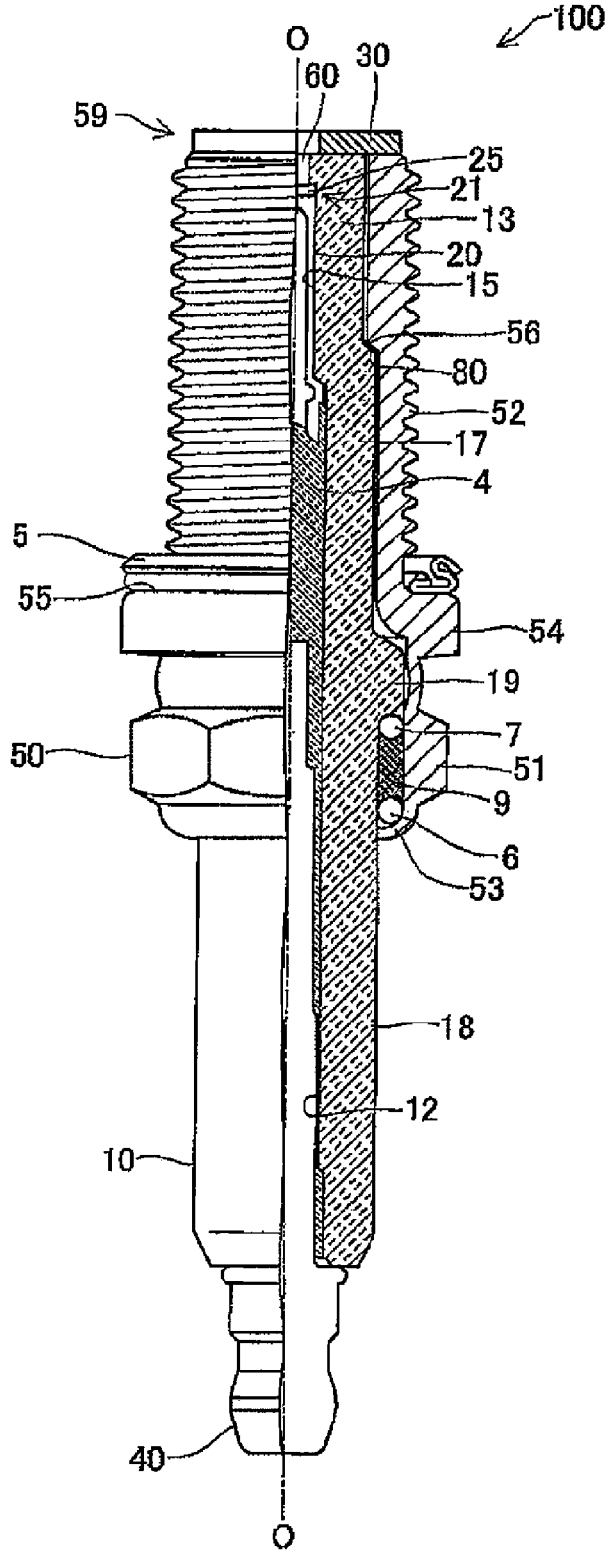
FIG. 1 is a partial sectional view showing the structure of an ignition plug 100.
Figure 2:
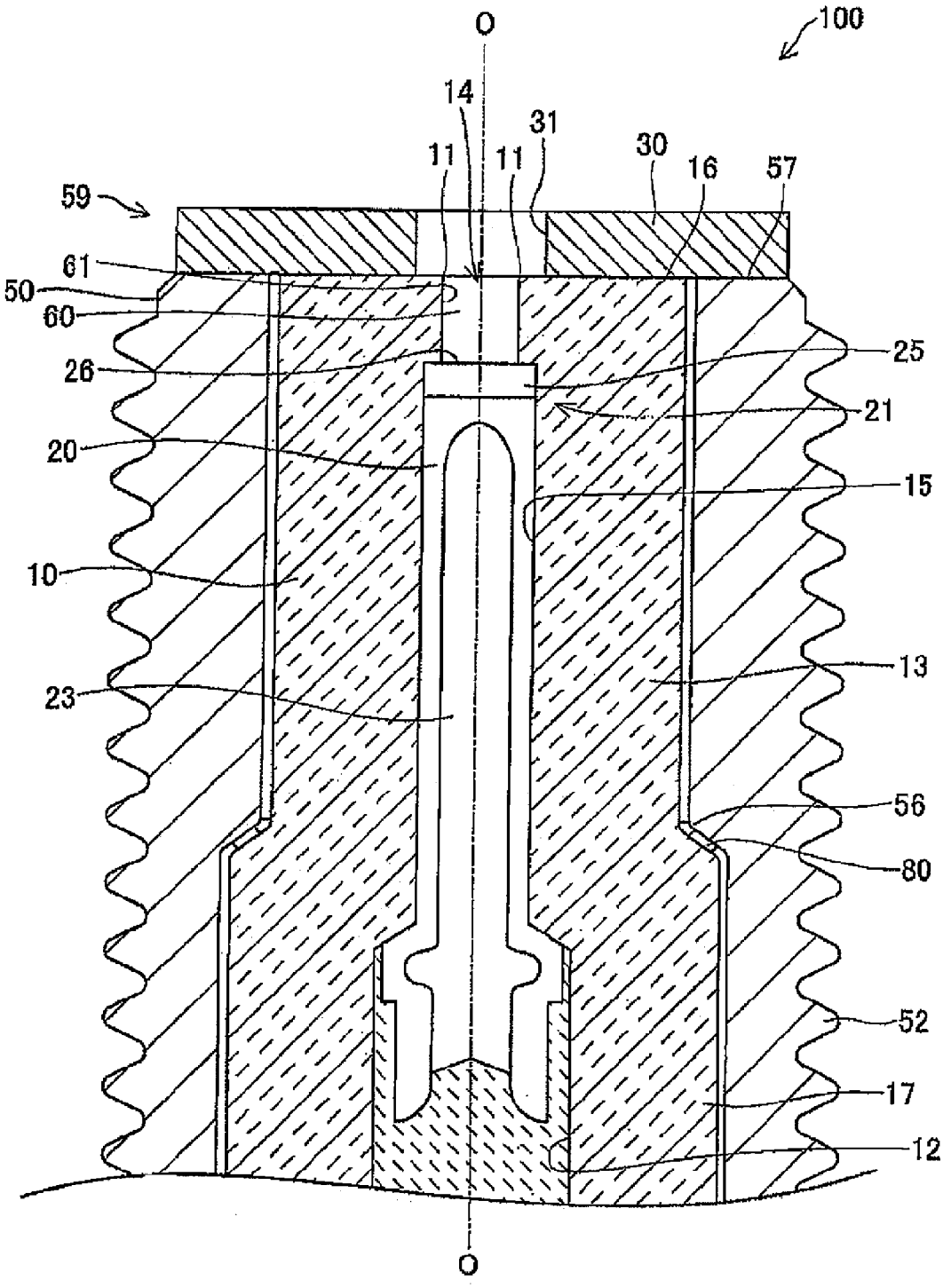
FIG. 2 is an enlarged sectional view of a leading end portion of the ignition plug 100.

A. Structure of Ignition Plug;

FIG. 1 is a partial sectional view showing the structure of an ignition plug 100. In addition, FIG. 2 is an enlarged sectional view of a leading end portion of the ignition plug 100. Note that in FIG. 1, a direction of an axis O of the ignition plug 100 is referred to as a vertical direction as viewed in the figure, and the description will be implemented with an upper side of the ignition plug 100 referred to as a leading end side and a lower side as a rear end side.

As shown in FIG. 1, the ignition plug 100 includes a porcelain insulator 10 as an insulators a metal shell 50 which holds the porcelain insulator 10, a center electrode 20 which is hold in the axis O direction within the porcelain insulator 10, a ground electrode 30 which is welded to a leading end portion 59 of the metal shell 50, and a metal terminal casing 40 which is provided at a rear end portion of the porcelain insulator 10.

The porcelain insulator 10 is formed by calcining aluminum oxide and is a cylindrical insulation member having an axial hole 12 extending in the direction of the axis O. A collar portion 19 having a largest outside diameter is formed substantially in the center of the porcelain insulator 10 in the direction of the axis O thereof, and a rear end side body portion 18 is formed so as to extend from collar portion 19 towards a rear end side of the porcelain insulator 10. In addition, formed so as to extend from collar portion 19 towards a leading end side of the porcelain insulator 10 is a leading end side body portion 17 having a smaller outer diameter than that of the rear end side body portion 18 and an extended leg portion 13 having a outer outside diameter than that of the leading end side body portion 17. The extended leg portion 13 is positioned closer to the leading end side than the leading end side body portion 17. A boundary position between the extended leg portion 13 and the leading end side body portion 17 is formed into a step-like portion.

As shown in FIG. 2, a portion of the axial hole 12 which corresponds to an inner circumference of the extended leg portion 13 is formed as an electrode accommodating portion 15. Electrode accommodating portion 15 is formed having a diameter smaller than a portion which corresponds to inner circumferences of the leading end side body portion 17, the collar portion 19 and the rear end side body portion 18. The center electrode 20 is held in an interior of the electrode accommodating portion 15. In addition, the inner circumference or inside diameter of the axial hole 12 is reduced further at a leading end side of the electrode accommodating portion 15, so that the portion of the axial hole 12 whose inside diameter is so reduced is formed as a leading end smallest diameter portion 61. In addition, the inner circumference of the leading end smallest diameter portion 61 continues to a leading end face 16 of the porcelain insulator 10, so as to form an opening 14 of the axial hole 12.

The center electrode 20 is a cylindrical electrode rod which is formed of a Ni-based alloy such as Inconel (trade name) 600 or 601 and has in an interior thereof a metal core 23 which is made of a copper having superior heat conductivity. In addition, a disk-shaped electrode chip 25, which is made of an alloy mainly made of a noble metal and tungsten, is welded to a leading end portion 21 of the renter electrode 20 so as to be integral with the center electrode 20. In addition, in this embodiment, the center electrode 20 and the electrode chip 25 which is made integral with the center electrode 20 are referred to as the "center electrode." This electrode chip 25 can be omitted from the construction of the center electrode 20.

A rear end side of the center electrode 20 is diametrically expanded into a collar-like portion, and this collar-shaped portion is brought into abutment with a stepped portion which configures a starting point of the electrode accommodating portion 15 within the axial hole 12, whereby the center electrode 20 is positioned within the electrode accommodating portion 15. In addition, a circumferential edge of a leading end face 26 of the leading end portion 21 of the center electrode 20 (more specifically, the leading end face 26 of the electrode chip 25) is in abutment with a stepped portion between the electrode accommodating portion 15 and the leading end smallest diameter portion 16 which have different diameters. By this configuration, a cavity 60 (hereinafter, also referred to as a "cavity" from time to time) which has a small capacity is formed so as to be surrounded by an inner circumferential surface of the leading end smallest diameter portion 61 of the axial hole 12 and the leading end face 26 of the center electrode 20. Spark discharge performed in a spark discharge gap between the ground electrode 30 and the center electrode 20 passes through a space within the cavity 60 and a wall surface thereof. Then, plasma is formed within the cavity 60 by energy applied after dielectric breakdown has been occurred by the spark discharge. The plasma so formed is ejected from an open end 11 of the opening 14.

As shown in FIG. 1, the center electrode 20 is electrically connected to the rear end side metal terminal casing 40 by way of a conductive seal material 4 which is made of a mixture of metal and glass and is provided in the interior of the axial hole 12. The center electrode 20 and the metal terminal casing 40 are fixed in place and are made to communicate electrically with each other within the axial hole 12 by the seal material 4. A high tension cable which is connected to an ignition control device via a plug cap is connected to the metal terminal casing 40.

The metal shell 50 is a cylindrical metal casing for fixing the ignition plug 100 to an engine head of an internal combustion engine and holds the ignition plug 100 so as to surround the porcelain insulator 10. The metal shell 50 is formed of an iron-based material and includes a tool engagement portion 51 on which a plug wrench is fit and a thread portion 52 which is threaded into the engine head provided on the internal combustion engine.

A crimped portion 53 is provided on the metal shell 50 in a position lying further towards the rear end side than the tool engagement portion 51. Annular ring members 6, 7 are interposed between the a portion of the metal shell 50 extending from the tool engagement portion 51 to the crimped portion 53 and the rear end body portion 18 of the porcelain insulator 10. Furthermore, powder of talc 9 is loaded between the ring members 6, 7. By this crimped portion 53 being crimped, the porcelain insulator 10 is pressed towards the leading end side within the metal shell 50 via the ring members 6, 7 and the talc 9. By this action, as shown in FIG. 2, the stepped portion between the extended leg portion 13 and the leading end side body portion 17 is supported on a locking portion 56 which is formed into a step-like portion on an inner circumferential surface of the metal shell 50 via an annular packing 80, whereby the metal shell 50 and the porcelain insulator 20 are integrally assembled together. Gas-tightness is held between the metal shell 50 and the porcelain insulator 10 by the packing 80, whereby the leakage of combustion gases is prevented. In addition, as shown in FIG. 1, a collar portion 54 is formed between the tool engagement portion 51 and the thread portion 52, and a gasket 5 is fit on the metal shell 50 in a position lying in the vicinity of a rear end side of the thread portion 52 or on a seat surface 55 of the collar portion 54.

The plate-shaped ground electrode 30 having a thickness of about 1 mm is provided at the leading end portion 59 of the metal shell 50. The ground electrode 30 is made of a metal which has superior spark wear resistance, and for example, a Ni-based alloy such as Inconel (trade name) 600 or 601 is used. As shown in FIG. 2, the ground electrode 30 is formed into a disk shape having a through hole 31 in the center thereof and is joined to a leading end of the metal shell 50 in such a state that its thickness direction is aligned with the direction of the axis O and it is in abutment with the leading end face 16 of the porcelain insulator 10. The through hole 31 in the ground electrode 30 is formed so that its smallest inside diameter is equal to or larger than at least an inside diameter of the opening 14 (the open end 11) of the porcelain insulator 10, and an interior of the cavity 60 communicates with the outside air via this through hole 31.

In the ignition plug 100 that is configured as has been described heretofore, when an air-fuel mixture is ignited, firstly, a high voltage is applied between the center electrode 20 and the ground electrode 30 so as to implement spark discharge. A current is allowed to flow between the center electrode 20 and the ground electrode 30 at a relatively low voltage by dielectric breakdown generated when the spark is discharged. Then, by electric power being supplied further between the center electrode 20 and the ground electrode 30, a transition of discharging state is produced, so as to form plasma within the cavity 60. The plasma so formed is then ejected through the through hole 31 (so-called orifice) to thereby ignite the air-fuel mixture.

B. First Exemplary Embodiment

Figure 3:
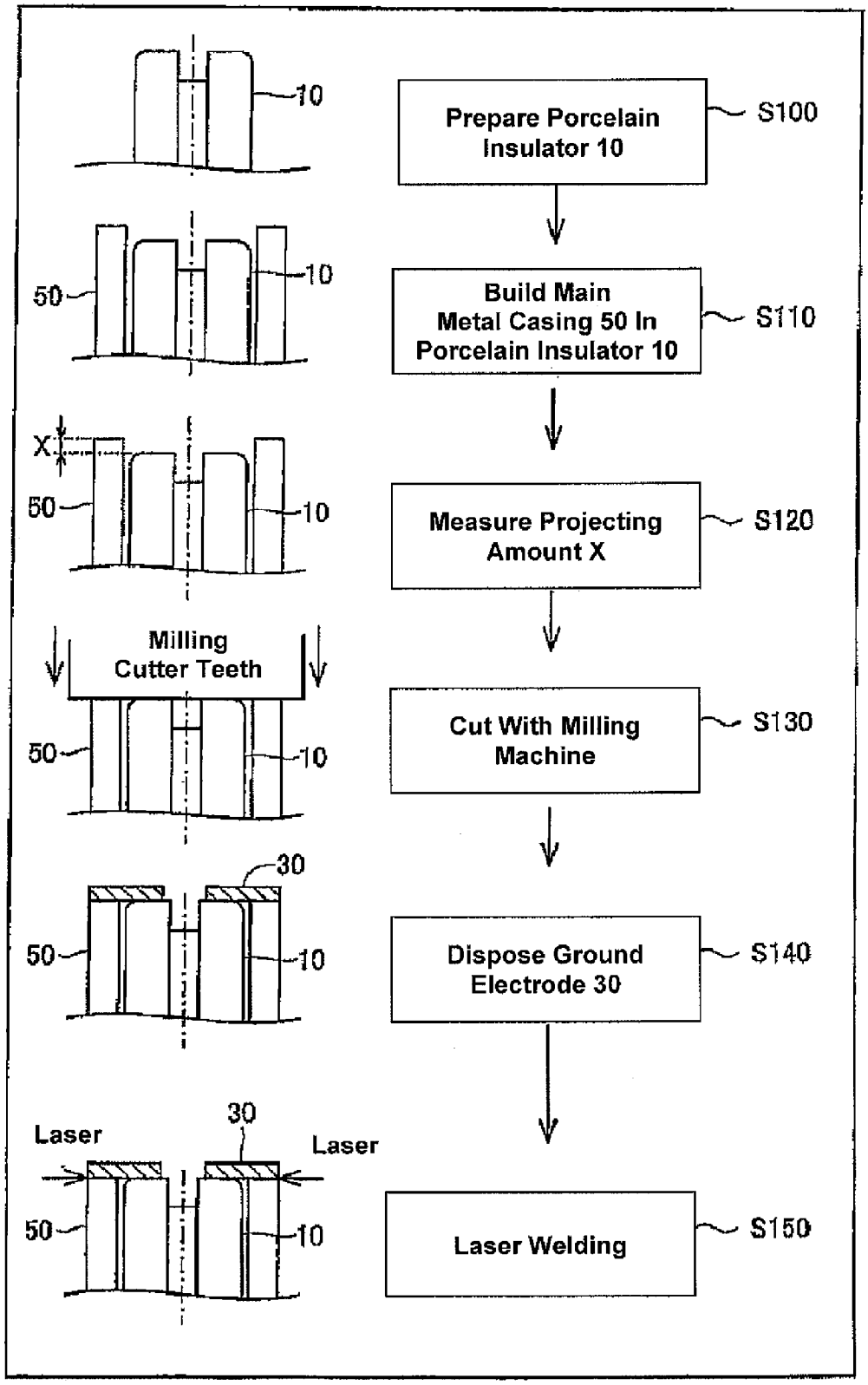
FIG. 3 is a diagram showing a method for manufacturing an ignition plug according to a first exemplary embodiment.

FIG. 3 is a diagram showing an ignition plug manufacturing method according to a first exemplary embodiment of the present invention. As shown in FIG. 3, in this embodiment, firstly, a porcelain insulator 10 in which a center electrode 20 is built in advance is prepared in a separate manufacturing step (step S100: a preparation step). Then, the porcelain insulator 10 is inserted into a metal shell 50, and by crimping a crimped portion 53 of the metal shell 50, the porcelain insulator 10 is built in the metal shell 50 (step S110: a build-in step). A leading end portion of the metal shell 50 is formed in advance with a length that is longer by 0.5 mm or more than a specified dimension.

Following this, a distance from a leading end face 57 of the metal shell 50 to a leading end face of the porcelain insulator 10 (hereinafter, referred to as a projecting amount X) is measured by the use of a laser distance measuring device (step S120: a measuring step). This projecting amount can be measured by measuring distances from a predetermined position to the leading end face 57 of the metal shell 50 and the leading end face 16 of the porcelain insulator 10 by the use of the distance measuring device, respectively, and obtaining a difference between the measured distances. Note that in addition to the laser distance measuring device, various other types of measuring devices, such as an ultrasonic measuring device and a slide caliper, can be used to measure the distances.

Following the measurement of the projecting amount X in the way described above, the metal shell 50 which holds the porcelain insulator 10 is fixed to a milling machine by the use of a vise. Then, milling cutter teeth of the milling machine are pressed against the leading end face 57 of the metal shell 50 at right angles to cut the leading end portion of the metal main casing 50 by the projecting amount X along the axis O for removal (step S130: a removal step). In this embodiment, a working diameter of the milling cutter teeth is made to be larger than an outside diameter of the metal shell 50.

When the leading end portion of the metal shell 50 is cut in the way described above, the ground electrode 30 is disposed at the leading end face 57 of the metal shell 50 (step S140). Then, a boundary portion between the ground electrode 30 and the metal shell 50 are laser welded together along a full circumference thereof (step S150: a welding step). An ignition plug 100 is completed at the end of the series of steps that have been described above.

In the manufacturing method of the first exemplary embodiment that has been described above, by forming in advance the metal shell 50 slightly longer than the specified length, the leading end portion of the metal shell 50 is in a state wherein it projects further outwards than the leading end face 16 of the porcelain insulator 10 when the porcelain insulator 10 is built in the metal shell 50. Then, in this state, the projecting amount of the metal shell 50 is measured, and the leading end portion of the metal shell 50 is cut by the amount so measured. According to the manufacturing method described above, even though fixing positions of porcelain insulators 10 within metal shells 50 vary from metal shell to metal shell in the build-in step of step S110) the leading end face 57 of the metal shell 50 can be brought into horizontal abutment with the leading end face 16 of the porcelain insulator 10 with high accuracy. As a result, since the generation of a gap between the ground electrode 30 and the leading end face 16 of the porcelain insulator 10 can be suppressed, the manufacturing of the ignition plug 100 having an intended igniting performance can be realized. In addition, in the manufacturing method of this embodiment, when the distance from the leading end face of the porcelain insulator 10 to the leading end face of the metal shell 50 is determined in advance or cutting based on a visual measurement is possible, the measurement of the projecting amount X in step S120 (the measuring step) in FIG. 3 can be omitted.

In addition, in this embodiment, in consideration of the fact that the build-in tolerance of the porcelain insulator into the metal shell is of the order of 0.4 mm, the leading end portion of the metal shell 50 is formed in advance with a length that is longer by 0.5 mm or more than the specified dimension. Accordingly, even though there is a resulting variation in accuracy with which the porcelain insulator is built in the metal shell, the needed cutting margin can be ensured.

C. Second Exemplary Embodiment

Figure 4:
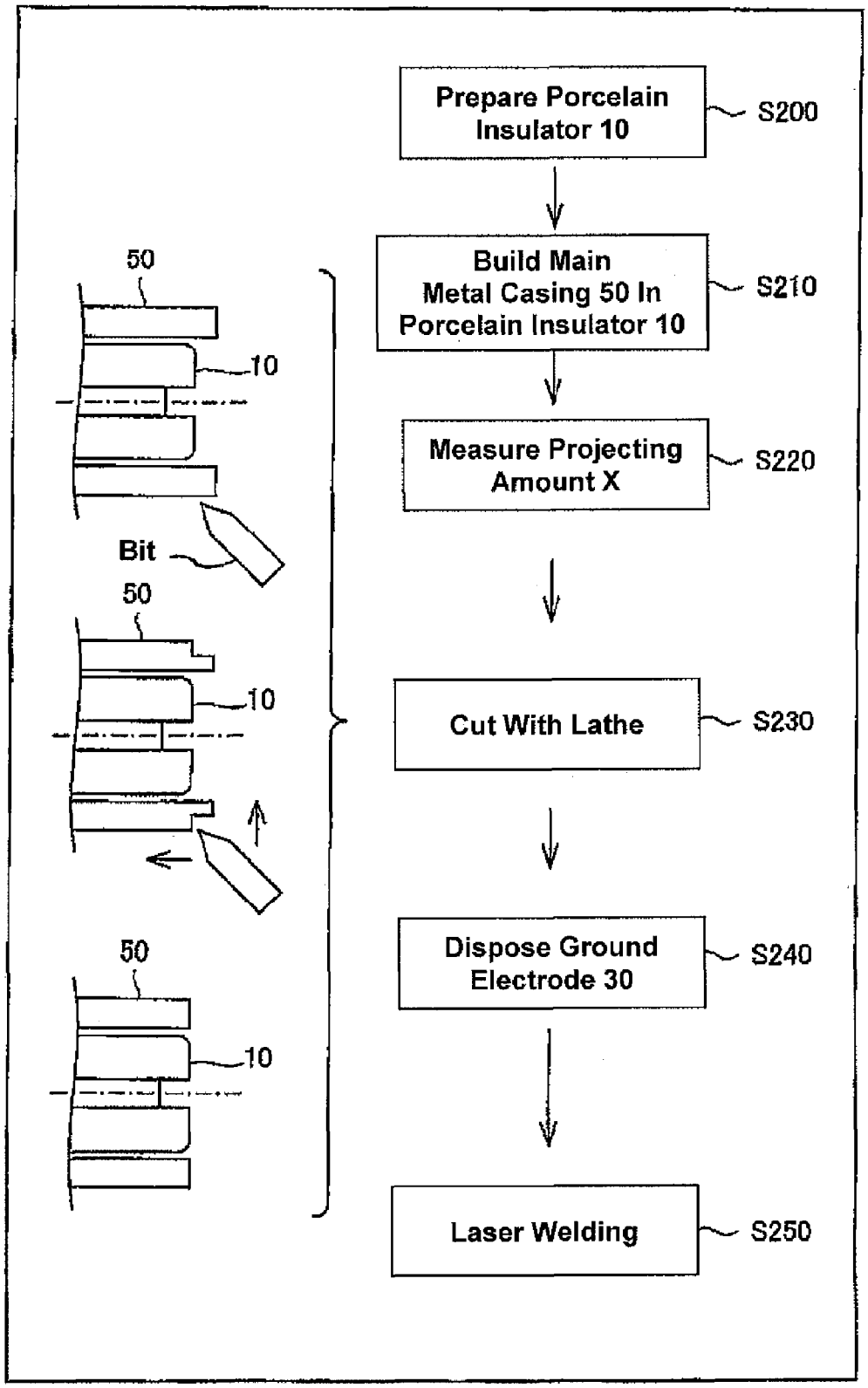
FIG. 4 is a diagram showing a method for manufacturing an ignition plug according to a second exemplary embodiment.

FIG. 4 is a diagram showing an ignition plug manufacturing method as a second exemplary embodiment of the present invention. As shown in FIG. 4, in this embodiment, similar to steps S100 to S120 described in the first exemplary embodiment, a porcelain insulator 10 in which a center electrode 20 is built in advance is prepared (step S200: a preparation step), and the porcelain insulator 10 is built in a metal shell 50 (step S210: a build-in step), and a projecting distance X from a leading end face 57 of the metal shell 50 to a leading end face 16 of the porcelain insulator 10 is measured (step S220: a measuring step).

After the projecting amount X is measured, the metal shell 50 which holds the porcelain insulator 10 is fixed to a chuck of a lathe in a horizontal direction. Then, a cutting blade (bit) of the lathe is pressed against a side of the leading end portion of the metal shell 50 so as to cut the leading end portion of the metal main casing 50 by the projecting amount X along an axis O for removal (step S230: a removal step).

When the leading end portion of the metal shell 50 is cut in the way described above, similar to steps S140, 150 of the first exemplary embodiment, a ground electrode 30 is disposed at the leading end face 57 of the metal shell 50 (step S240), and the ground electrode 30 and the metal shell 50 are laser welded together (step S250: a welding step). An ignition plug 100 is completed at the end of the series of steps that have been described above.

According to the second exemplary embodiment that has been described above, by the use of the lathe in place of the milling machine, the leading end face 16 of the porcelain insulator 10 and the leading end face 57 of the metal shell 50 can be brought into horizontal abutment with each other. In addition, in the manufacturing method of this embodiment, when the distance from the leading end face of the porcelain insulator 10 to the leading end face of the metal shell 50 is determined in advance or cutting based on a visual measurement is possible, the measurement of the projecting amount X in step S220 (the measuring step) in FIG. 4 can be omitted.

D. Third Exemplary Embodiment

Figure 5:
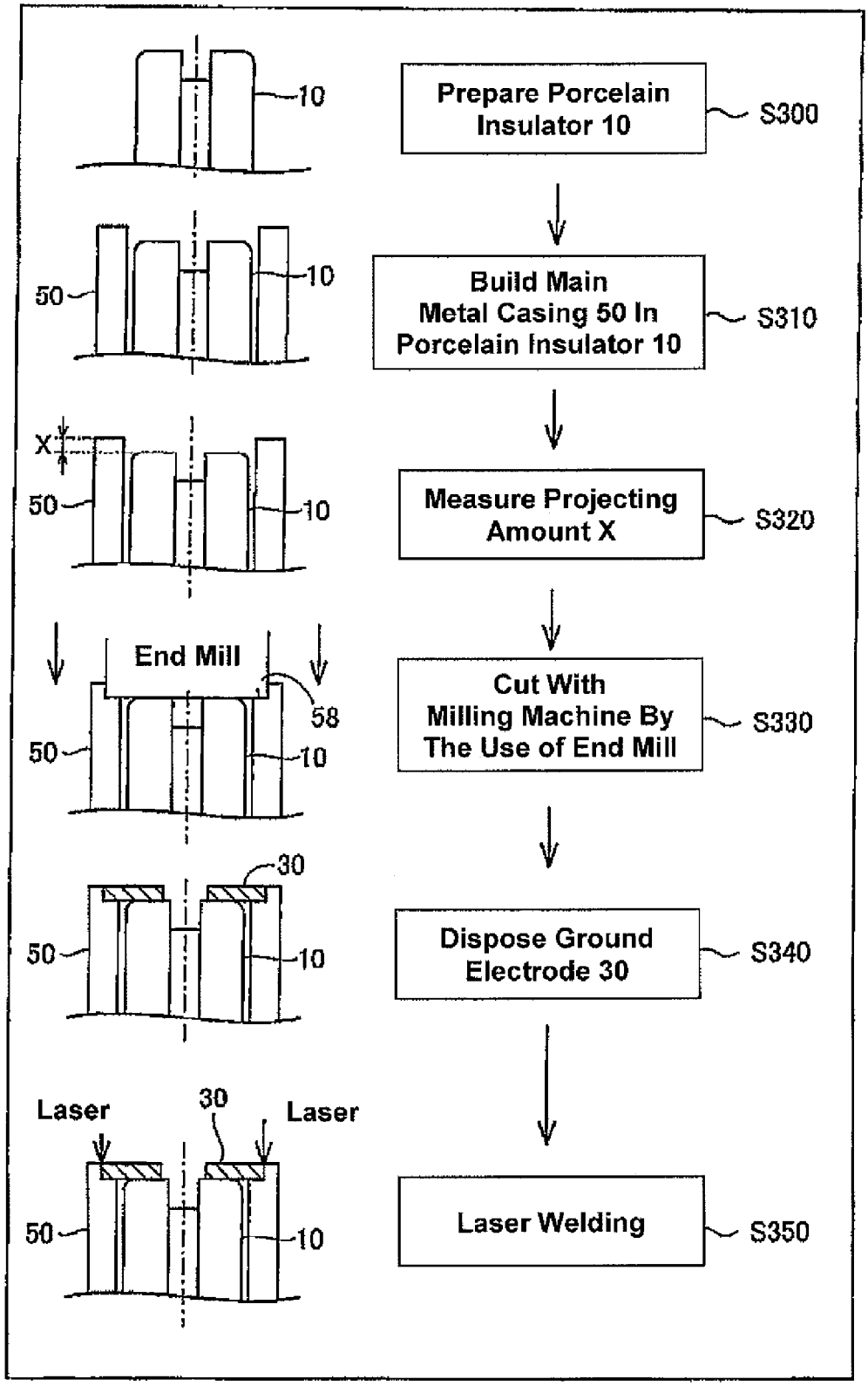
FIG. 5 is a diagram showing a method for manufacturing an ignition plug according to a third exemplary embodiment.

FIG. 5 is a diagram showing an ignition plug as a third exemplary embodiment of the present invention. As shown in FIG. 5, in this embodiment, similar to steps S100 to S120 described in the first exemplary embodiment, a porcelain insulator 10 in which a center electrode 20 is built in advance is prepared (step S300: a preparation step), and the porcelain insulator 10 is built in a metal shell 50 (step S310: a build-in step), and a projecting distance X from a leading end face 57 of the metal shell 50 to a leading end face 16 of the porcelain insulator 10 is measured (step S320: a measuring step). In this embodiment, a leading end portion of the metal shell 50 is formed in advance with a length that is longer by an amount (about 1 mm) equal to the thickness of the ground electrode 30 or more than a specified dimension.

After the projecting amount X is measured, the metal shell 50 which holds the porcelain insulator 10 is fixed to a vise of a milling machine on which an end mill is set. The end mill used for cutting the leading end portion of the metal shell 50 has a working diameter that is smaller than an outside diameter of the metal shell 50, but is larger than an inside diameter of the metal shell 50. When the metal shell 50 is fixed to the vise, a center axis of the end mill is aligned with a center axis of the metal shell 50. Then, by pressing the end mill against the leading end face 57 of the metal shell 50 from a perpendicular direction, an inner circumferential side of the leading end portion of the metal shell 50 is cut by the projecting amount X for removal (step S330: a removal step). By the series of actions being performed, part of the leading end portion of the metal shell 50 is cut to thereby form a stepped portion 58.

When the stepped portion 58 is formed at the leading end portion of the metal shell 50, a ground electrode 30 is disposed within the stepped portion 58 (step S340). Then, a boundary between the ground electrode 30 and the metal shell 50 is laser welded along a full circumference thereof (step S350: a welding step). An ignition plug 100 is completed at the end of the series of steps that have been described above.

According to the third exemplary embodiment that has been described above, by the use of the end mill, the stepped portion can be formed at the leading end portion of the metal shell 50, so that the ground electrode 30 can be joined to the stepped portion so formed. Because of this, the ground electrode 30 can be disposed accurately. In addition, in the manufacturing method of this embodiment, when the distance from the leading end face of the porcelain insulator 10 to the leading end face of the metal shell 50 is determined in advance or cutting based on a visual measurement is possible, the measurement of the projecting amount X in step S320 (the measuring step) in FIG. 5 can be omitted.

E. Fourth Exemplary Embodiment

The ground electrode 30 provided at the leading end of the ignition plug 100 is formed by a metal such as a Ni-based alloy. In contrast to this, in a fourth exemplary embodiment, as the ground electrode 30, an electrode is used in which a noble metal member is joined to a center of an electrode base material of a Ni-based alloy.

Figure 6:
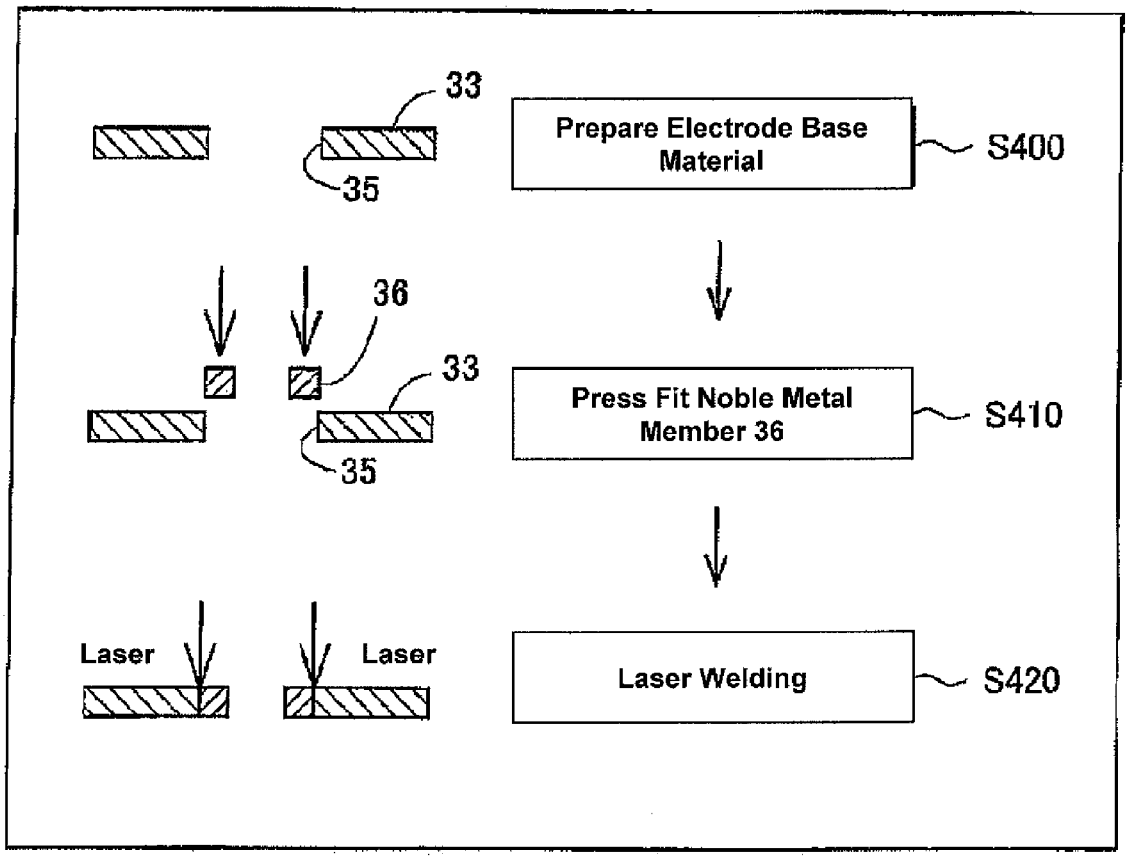
FIG. 6 is a diagram showing a manufacturing method of a ground electrode 30 which is used in a fourth exemplary embodiment.

FIG. 6 is a diagram showing a manufacturing method of a ground electrode 30 used in this embodiment. As shown in the figure, in this manufacturing method, firstly, a ground electrode base material 33 is prepared which has an opening 35 in a center thereof (step S400). Then, a ring-shaped noble metal member 36, in which a through hole 31 is formed in a center thereof in advance, is press fit in the opening 35 of the electrode base material 33 (step S410). The thickness of this noble metal member 36 is the same as the thickness of the electrode base material 33. The noble metal member 36 can be formed of an Ir alloy in which platinum (Pt), rhodium (Rh), ruthenium (Ru), palladium (Pd), rhenium (Re) or the like is added to iridium (Ir) which comprises a main constituent. In addition, the noble metal member 36 can also be formed of an alloy in which iridium (Ir), rhodium (Rh), ruthenium (Ru), palladium (Pd), rhenium (Re) or the like is added to platinum which comprises a main constituent.

After the noble metal member 36 is press fit in the opening 35 of the electrode base material 33, a boundary between the noble metal member 36 and the electrode base material 33 is then laser welded along a full circumference thereof on one side of the ground electrode 30.

Figure 7:
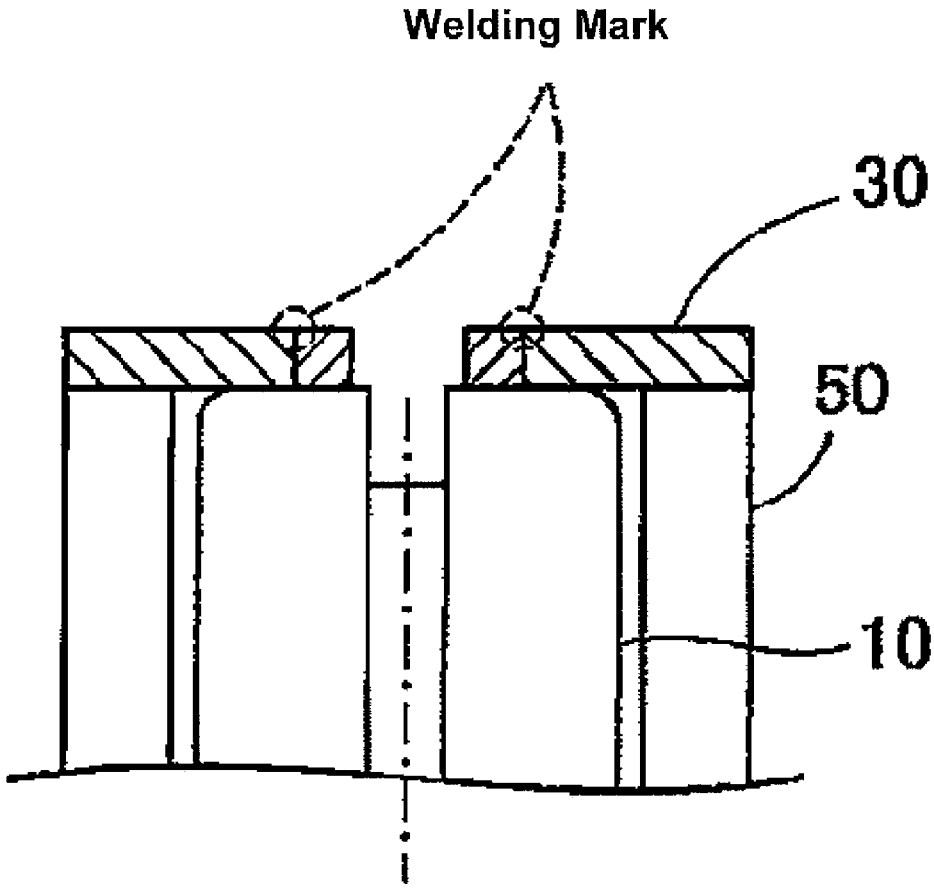
FIG. 7 is a diagram showing a disposing method of the ground electrode 30 which is used in the fourth exemplary embodiment.

After the ground electrode 30 is manufactured by the method that has been described above, an ignition plug 100 is manufactured according to similar steps to those described in the first to third embodiments. However, when the ground electrode 30 is disposed at a leading end face 57 of a metal shell 50, as shown in FIG. 7, the ground electrode 30 is disposed in such a manner that the side where the laser welding has been implemented is oriented to a side opposite the leading end face 57 of the metal shell 50. By adopting this configuration, the generation of a gap between the ground electrode 30 and a porcelain insulator 10 can be suppressed which would otherwise be caused by welding marks.

According to the fourth exemplary embodiment that has been described above, since the noble metal member 36 is joined to the central portion of the ground electrode 30, an ignition plug 100 can be manufactured which has superior durability.

In addition, in the fourth exemplary embodiment that has been described above, the thickness of the electrode base material 33 is made the same as that of the noble metal member 36. In contrast to this, the thickness of the noble metal member 36 can be made thicker than the thickness of the electrode base material 33.

Figure 8:
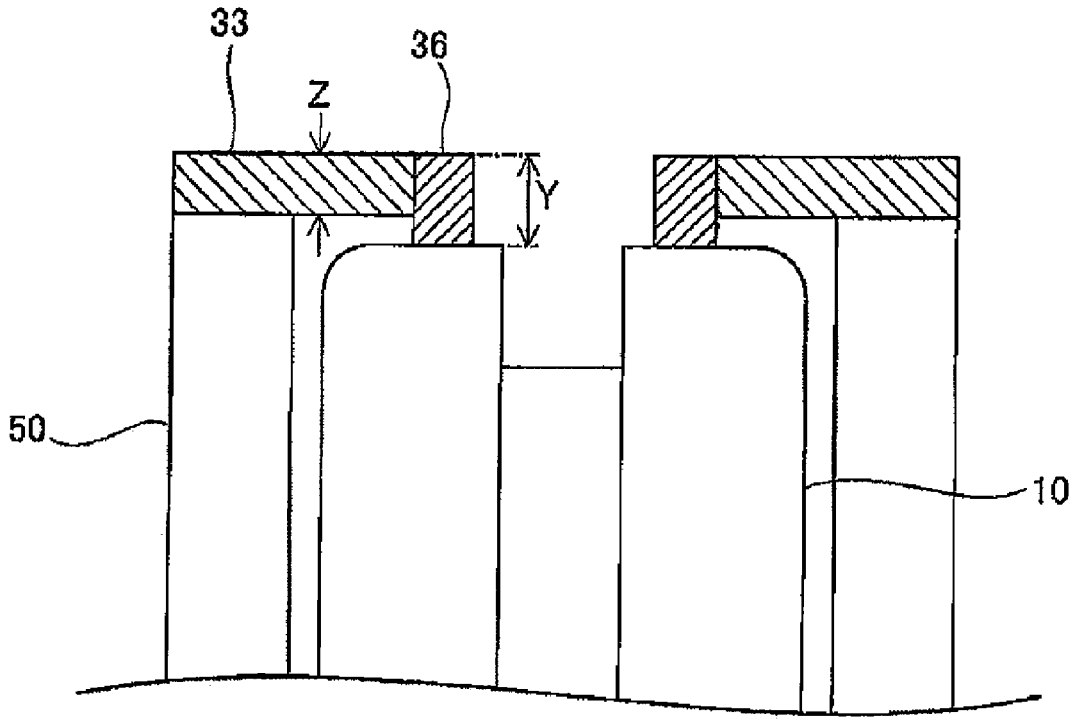
FIG. 8 is a diagram showing an example in which the ignition plug 100 is manufactured by a noble metal member 36 which is thicker than an electrode base material 33.

FIG. 8 is a drawing showing an embodiment in which an ignition plug 100 is manufactured by the use of a noble metal member 36 which is thicker than an electrode base material 33. As shown in the figure, even though the noble metal member 36 is formed thicker than the electrode base material 33, in the event that the noble metal member 36 is in abutment with a leading end face 16 of a porcelain insulator 10, the generation of a gap between a resulting ground electrode 30 and the porcelain insulator 10 can be suppressed. Because of this, even in this embodiment, an ignition plug 100 having an intended igniting performance can be manufactured. In addition, in this embodiment, as shown in FIG. 8, when the electrode base material 33 is brought into horizontal abutment with an upper side of the noble metal member 36, a projecting amount X' of a leading end portion of a metal shell that is to be cut by the milling machine or the lathe can be calculated by an expression (1) below.

$$X'=X-Y+Z \quad (1)$$

(where, X denotes a distance from the leading end face 16 of the porcelain insulator 10 to the leading end face 57 of the metal shell 50, Y denotes the thickness of the noble metal member 36, and Z denotes the thickness of the electrode base material 33).

F. Fifth Exemplary Embodiment

In the first to fourth embodiments that have been described heretofore, the disk-shaped ground electrode 30 having the through hole 31 in the center thereof is joined to the leading end portion of the metal shell 50. In contrast to this, in the fifth exemplary embodiment, a rod-shaped (for example, a quadrangular prism-shaped) ground electrode is joined to a leading end portion of a metal shell 50.

Figure 9:
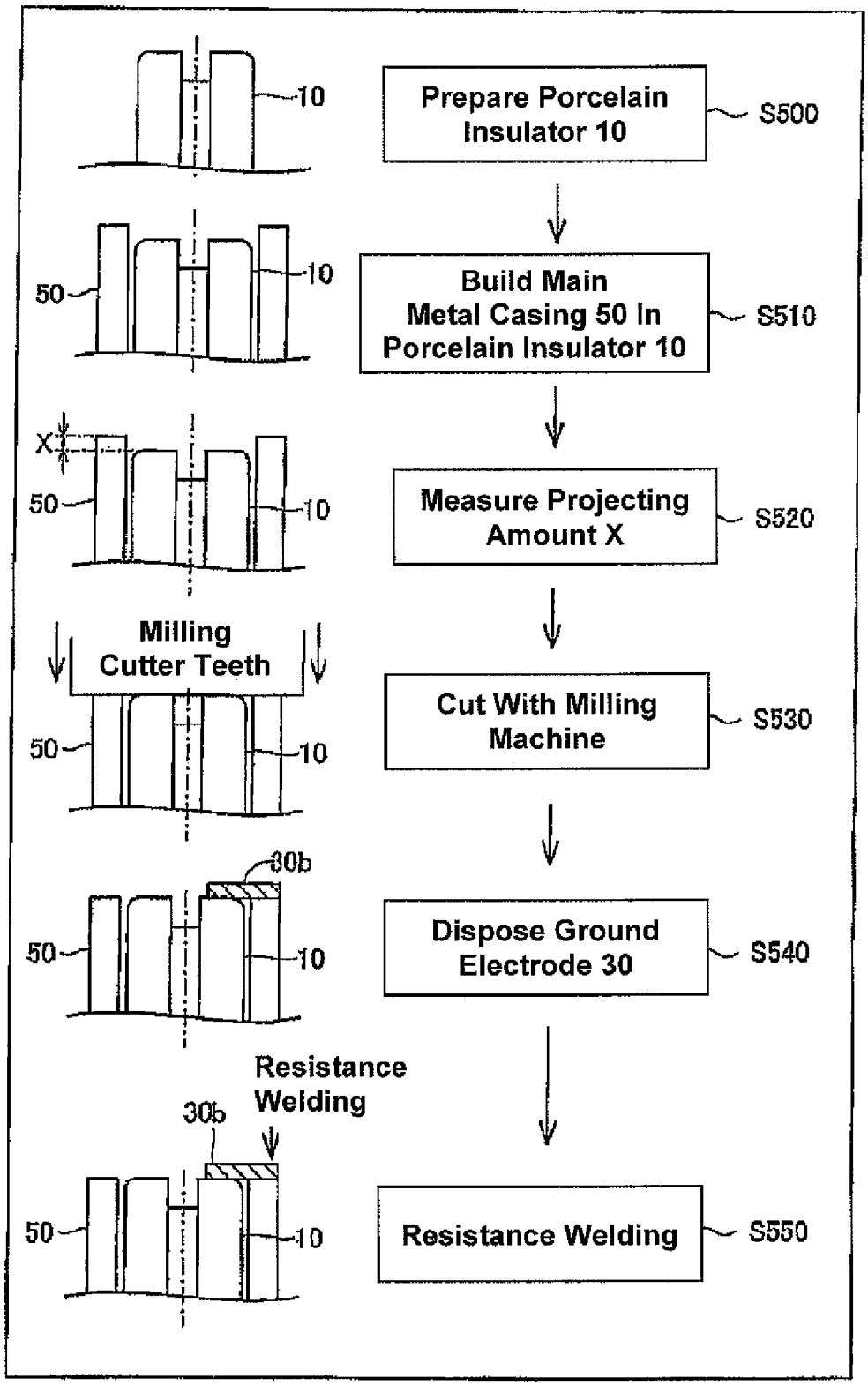
FIG. 9 is a diagram showing a method for manufacturing an ignition plug according to a fifth exemplary embodiment.

FIG. 9 is a diagram showing an ignition plug manufacturing method according to a fifth embodiment of the present invention. As shown in FIG. 9, in this embodiment, firstly, similar to steps S100 to S120, a porcelain insulator 10 in which a center electrode 20 is built is prepared (step S500: a preparation step). This porcelain insulator 10 is built in a metal shell 50 (step S510; a build-in step), and a projecting amount X from a leading end face 57 of the metal shell 50 to a leading end face 16 of the porcelain insulator 10 is measured (step S520: a measuring step).

When the projecting amount X is measured, the metal shell 50, which holds the porcelain insulator 10, is fixed to a milling machine by the use of a vise. Then, milling cutter teeth are pressed against the leading end face 57 of the metal shell 50 from a perpendicular direction, and a leading end portion of the metal shell 50 is cut by the projecting amount X along an axis O for removal (step S530: a removal step).

After the leading end portion of the metal shell 50 is cut in the way described above, a rod-shaped ground electrode 30*b* is disposed at the leading end face 57 of the metal shell 50, which has been cut in the way described above, in such a manner that a lateral surface of the rod-shaped ground electrode 30*b* contacts the metal shell 50 and the porcelain insulator 10 (step S540), and the ground contact 30*b* and the metal shell 50 are resistance welded together (step S550: a welding step). An ignition plug 100 is completed at the end of the series of steps that have been described above. In addition, in step S550, the ground electrode 30*b* may be laser welded to the metal shell 50.

According to the fifth exemplary embodiment that has been described above, the generation of a gap between the ground electrode 30*b*, which is formed into the rod shape, and the leading end face 16 of the porcelain insulator 10 can be suppressed. In addition, in the manufacturing method of this embodiment, when the distance from the leading end face of the porcelain insulator 10 to the leading end face of the metal shell 50 is determined in advance or cutting based on a visual measurement is possible, the measurement of the projecting amount X in step S520 (the measuring step) in FIG. 9 can be omitted. In addition, in this embodiment, while the leading end portion of the metal shell 50 is cut by the milling cutter teeth, as described in the second exemplary embodiment, the leading end portion of the metal shell 50 may be cut by the lathe or by the end mill as described in the third exemplary embodiment. In addition, in the embodiment, while only the single rod-shaped ground electrode 30*b* is joined to the metal shell 50, a plurality of rod-shaped ground electrodes 30*b* may be joined to the metal shell 50. As this occurs, in step S540 above, the respective ground electrodes 30*b* are preferably disposed on the metal shell 50 at uniform installation intervals.

G. Sixth Exemplary Embodiment

In the fifth exemplary embodiment that has been described above, the rod-shaped ground electrode 30*b* is joined to the leading end portion of the metal shell 50. In this embodiment, a noble metal member is joined to a leading end of such a rod-shaped ground electrode 30*b*.

Figure 10:
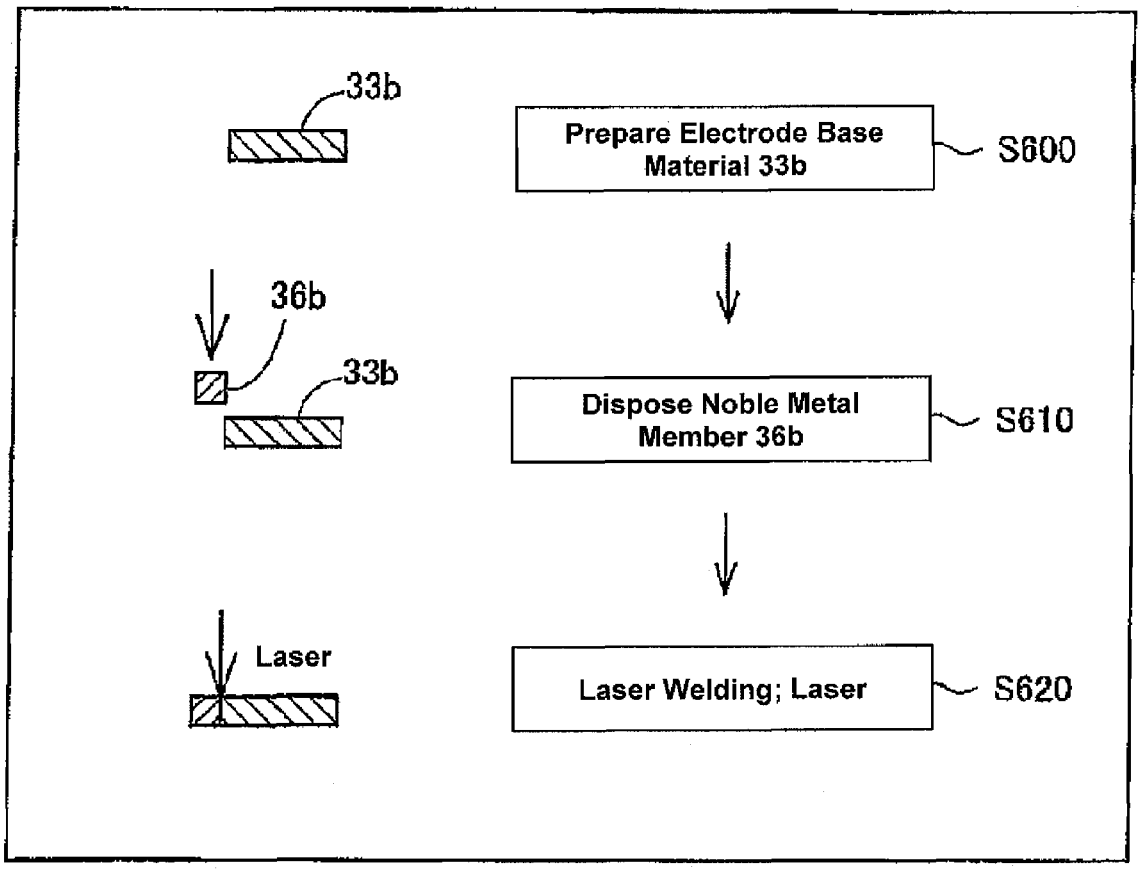
FIG. 10 is a diagram showing a manufacturing method of a ground electrode 30*b* which is used in a sixth embodiment.

FIG. 10 is a diagram showing a manufacturing method of a ground electrode 30*b* which is used in this embodiment. As shown in the figure, in this manufacturing method, firstly, a rod-shaped electrode base material 33*b* is prepared (step S600). Then, a noble metal member 36*b* is disposed at an end portion of the electrode base material 33*b* so prepared (step S610), and a boundary between the electrode base material 33*b* and the noble metal member 36*b* is laser welded together from one lateral side thereof (step S620).

When the ground electrode 30*b* is manufactured by the method described above, thereafter, in steps similar to those of the fifth exemplary embodiment, a ignition plug 100 is manufactured. However, when a ground electrode 30*b* is disposed at a leading end face 57 of a metal shell 50, a noble metal member 36*b* side is oriented to a center side of the ignition plug 100, while a electrode base material 33*b* side of the ground electrode 30*b* is oriented in a circumferential direction of the ignition plug 100. In addition, the ground electrode 30*b* is disposed so that the lateral side on which the laser welding has been implemented is oriented to a side opposite to the leading end face 57 of the metal shell 50. By adopting this configuration, the generation of a gap between the ground electrode 30*b* and a porcelain insulator 10 can be suppressed which would otherwise be caused by welding marks.

According to the sixth exemplary embodiment that has been described above, since the noble metal member 36*b* is joined to the leading end of the rod-shaped ground electrode 30*b*, the ignition plug 100 having superior durability can be manufactured. In addition, the electrode base material 33*b* and the noble metal member 36*b* may have the same thickness (the dimension in the direction of the axis O in such a state that they are joined to the metal shell 50), or as shown in FIG. 8, the thickness of the noble metal member 36*b* may be greater than the thickness of the electrode base material 33*b*.

H. MODIFIED EXAMPLES

Thus, while the various exemplary embodiments of the present invention have been described heretofore, the present invention is not limited to those embodiments, and, the present invention can adopt various configurations without departing from the spirit and scope thereof. For example, the following modifications are possible.

Figure 11:
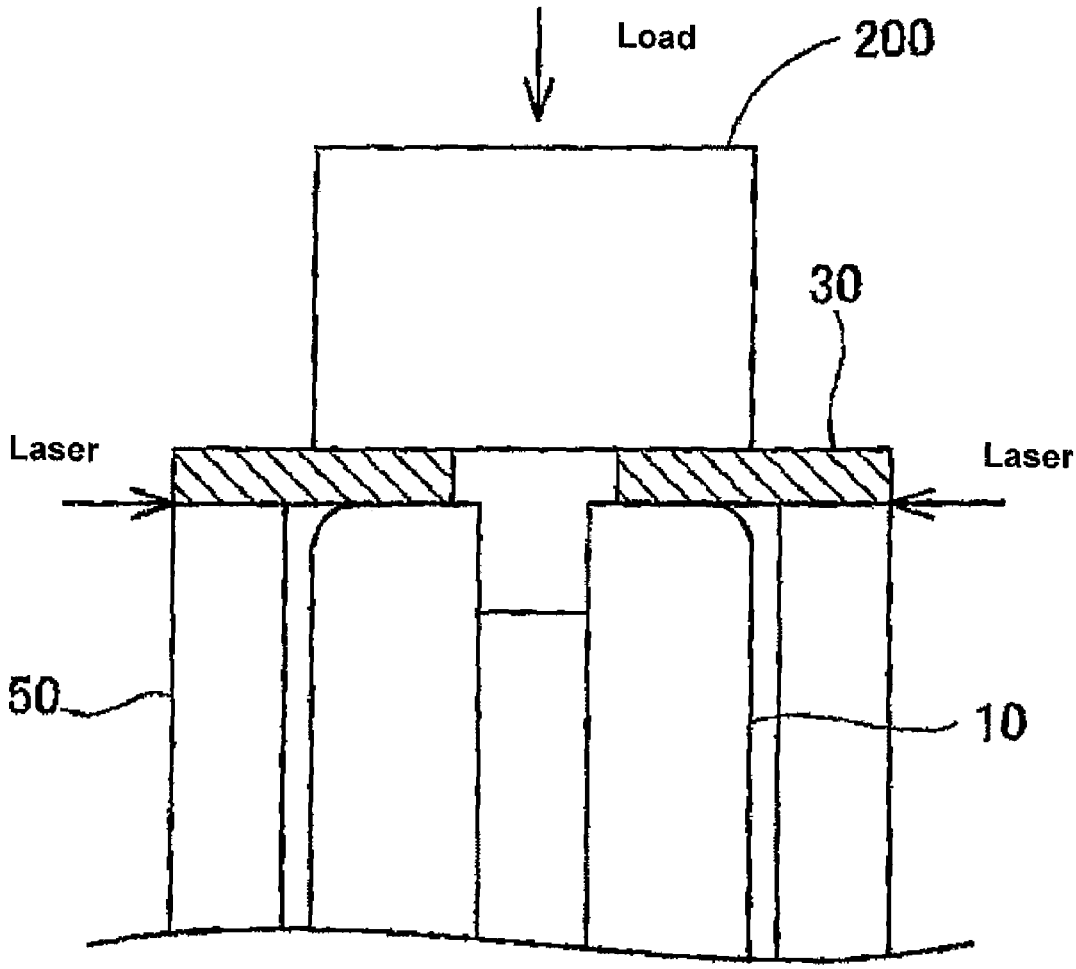
FIG. 11 is a diagram showing an example in which a laser welding is implemented by applying a load to the ground electrode 30.

In the welding step of the respective embodiments that have been described above, the ground electrode 30 is preferably laser welded to the leading end face 57 of the metal shell 50 while pressing the ground electrode 30 against the leading end face 57. FIG. 11 shows an example in which a predetermined fastening jig 200 is placed on the ground electrode 30, and a load is applied to the ground electrode 30 by the use of the fastening jig 200. In this way, in the event that the ground electrode 30 is welded to the metal shell 50 while the load is being applied to the ground electrode 30, the separation of the ground electrode 30 from the leading end face 57 of the metal shell 50 can be suppressed which would otherwise be caused by the impact generated at the time of laser welding. Note that the load applied to the ground electrode 30 is a load which does not deform the ground electrode 30 and which prevents the shift in position of the ground electrode 30 which would otherwise be caused by the impact generated at the time of laser welding. The load is generally of the order of 0.1 kN to 3 kN (preferably, 1 kN for the ground electrode 30 which is 1 mm thick).

In the measuring step of the respective embodiments, the projecting amount may be measured a plurality of times at different positions on the leading end face 16 of the porcelain insulator 10 so as to determine a cutting length by which the leading end portion of the metal shell 50 is to be cut by a mean value of the measured values. In addition, the cutting length may be determined as a length to a position whose projecting amount is smallest among the plurality of positions measured. Namely, the leading end portion of the metal shell 50 may be made to be cut not by the single measured projecting amount, but by the predetermined amount which is determined based on the plurality of projecting amounts measured in the way described above. In this way, by determining the cutting length based on the plurality of measurements, the leading end portion of the metal shell 50 can be cut with good accuracy.

In the welding step of the respective embodiments that have been described heretofore, the laser welding is performed towards the boundary between the ground electrode 30 and the metal shell 50. This welding can be implemented in the following various modes.

Figure 12:
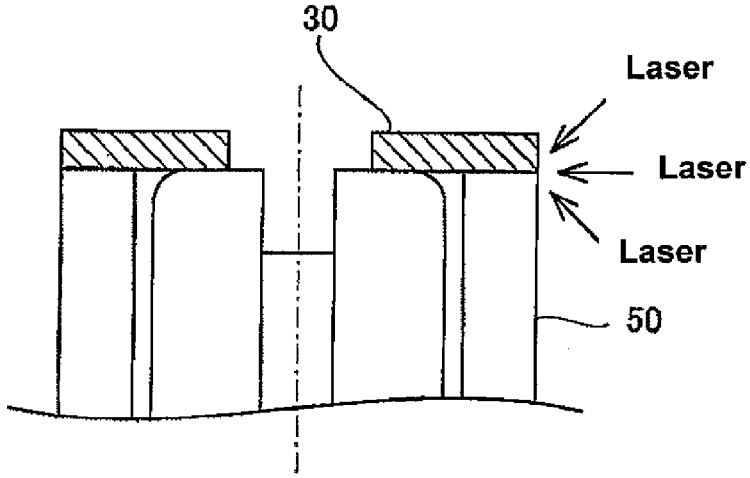
FIG. 12 is a diagram showing a variation of a method for joining the ground electrode 30 to a metal shell 50.
Figure 13:
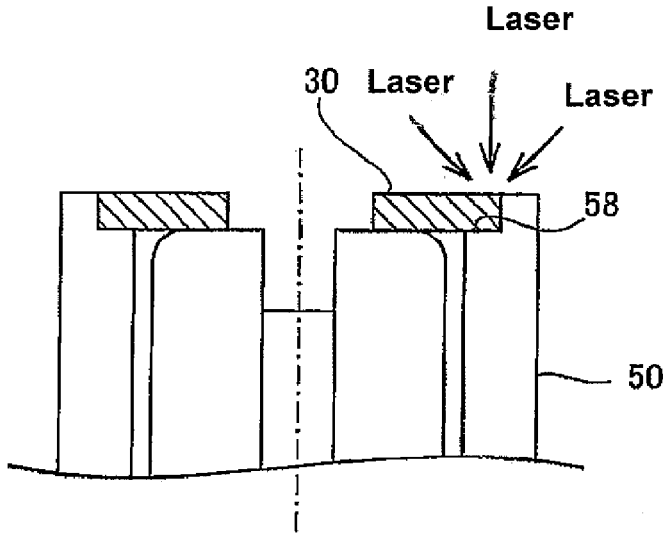
FIG. 13 is a diagram showing another variation of a method for joining the ground electrode 30 to the metal shell 50.
Figure 14:
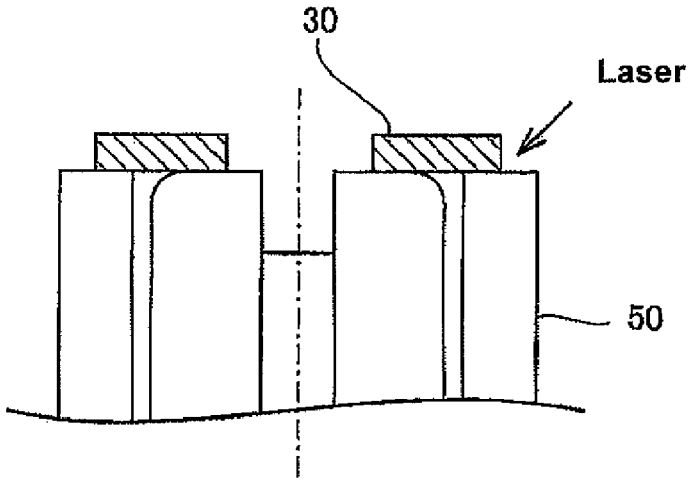
FIG. 14 is a diagram showing a further variation of a method for joining the ground electrode 30 to the metal shell 50.

FIGS. 12 to 14 are diagrams showing variations of joining methods for joining the ground electrode 30 to the metal shell 50. FIG. 12 shows variations of directions in which the laser welding is implemented. As shown in the figure, when the ground electrode 30 is joined to the metal shell 50, the laser welding may be implemented at right angles to the boundary between the ground electrode 30 and the metal shell 50 or the laser welding may be implemented obliquely from thereabove or therebelow.

FIG. 13 shows variations of directions in which the laser welding is implemented when the stepped portion 58 is formed at the leading end portion of the metal shell 50. As is shown in the figure, when the stepped portion 58 is formed at the leading end portion of the metal shell 50, the laser welding may be implemented at right angles to the boundary between the ground electrode 30 and the metal shell 50 or the laser welding may be implemented obliquely from thereabove or therebelow. Alternatively, the laser welding may be implemented towards the boundary between the ground electrode 30 and the metal shell 50 in an oblique direction from inside of the metal shell 50.

FIG. 14 shows an example in which a ground electrode 30 that is smaller in diameter than an outside diameter of a metal shell 50 is placed on a leading end face of the metal shell 50. In this case, both the members can be joined together by implementing a laser welding relative to a boundary between the ground electrode 30 and the metal shell 50 in an oblique direction from outside of the metal shell 50.

In addition, in the respective embodiments that have been described above, while the ground electrode 30 and the metal shell 50 are joined together through laser welding, they may be joined together by other welding methods including resistance welding. Additionally, in the respective embodiments that have been described above, while the leading end portion of the metal shell 50 is described as being cut, the leading end portion of the metal shell 50 may be removed by other removing methods including abrasion and a different way of cutting from the cutting described above.

According to a first illustrative aspect of the present invention, there is provided a manufacturing method for an ignition plug comprising an insulator having an axial hole and a center electrode provided in the axial hole, a substantially cylindrical metal shell and a plate-shaped ground electrode having a through hole formed in a center thereof, the manufacturing method comprising: a preparation step of preparing an insulator having a cavity provided at a leading end portion thereof by disposing a leading end of the center electrode more inwards than a leading end of the insulator; a build-in step of building the insulator in an interior of the metal shell in such a manner that the leading end of the insulator is situated closer to a rear end side than the leading end of the metal shell; a removal step of removing at least part of a leading end portion of the metal shell which projects from a leading end face of the insulator; and a welding step of disposing the ground electrode at the leading end portion of the metal shell and welding the ground electrode and the metal shell together after the removal step.

According to the first illustrative aspect of the present invention, at least part of the leading end portion of the metal shell which projects from the leading end face of the insulator is removed, and thereafter, the ground electrode is welded to the leading end portion of the metal shell. Because of this, it becomes possible to manufacture the ignition plug in which the gap between the insulator and the ground electrode is eliminated.

According to a second illustrative aspect of the present invention, there is provided an ignition plug manufacturing method as set forth in the first illustrative aspect, comprising further a measuring step of measuring a projecting amount by which the metal shell projects from the leading end face of the insulator prior to the removal step, wherein in the removal step, at least part of the leading end portion of the metal shell is removed a predetermined amount based on the projecting amount so measured. According to the second illustrative aspect, the projecting amount by which the metal shell projects from the leading end face of the insulator is measured, and the leading end portion of the metal shell can be removed, the predetermined amount based on the projecting amount so measured. Because of this, it becomes possible to bring the leading end face of the metal shell into accurate abutment with the leading end face of the insulator.

According to a third illustrative aspect of the present invention, there is provided a manufacturing method for an ignition plug comprising an insulator having an axial hole and a center electrode provided in the axial hole, a substantially cylindrical metal shell and a plate-shaped ground electrode having a through hole formed in a center thereof, the manufacturing method comprising: a ground electrode manufacturing step of manufacturing the ground electrode by joining a noble metal member in which the through hole is formed to a central portion of a plate-shaped electrode base material; a preparation step of preparing an insulator having a cavity provided at a leading end portion thereof by disposing a leading end of the center electrode more inwards than a leading end of the insulator; a build-in step of building the insulator in an interior of the metal shell in such a manner that the leading end of the insulator is situated closer to a rear end side than the leading end of the metal shell; a removal step of removing at least part of a leading end portion of the metal shell which projects from a leading end face of the insulator; and a welding step of disposing the ground electrode at the leading end portion of the metal shell and welding the ground electrode and the metal shell together after the removal step.

According to the third illustrative aspect of the present invention, it becomes possible to manufacture the ignition plug in which the gap between the insulator and the ground electrode is eliminated. Further, since the noble metal member in which the through hole is formed is joined to the central portion of the ground electrode, the durability of the ignition plug can be increased.

According to a fourth illustrative aspect of the present invention, there is provided an ignition plug manufacturing method as set forth in the third illustrative aspect of the present inventions further comprising a measuring step of measuring a projecting amount by which the metal shell projects from the leading end face of the insulator prior to the removal step. In the removal step, at least part of the leading end portion of the metal shell is removed a predetermined amount based on the projecting amount so measured. According to this manufacturing method, it becomes possible to bring the leading end face of the metal shell into accurate abutment with the leading end face of the insulator.

According to a fifth illustrative aspect of the present invention, there is provided an ignition plug manufacturing method as set forth in the third illustrative aspect or the fourth illustrative aspect of the present invention, wherein in the ground electrode manufacturing step, the noble metal member is joined to the electrode base material by laser welding the noble metal member to the electrode base material from one surface of the electrode base material, and wherein in the welding step, the ground electrode and the metal shell are welded together with the one surface of the ground electrode oriented to a side opposite to the leading end portion of the metal shell. According to this manufacturing method, it becomes possible to suppress the generation of a gap between the ground electrode and the insulator which would otherwise be caused by welding marks resulting from the laser welding.

According to a sixth illustrative aspect of the present invention, there is provided a manufacturing method for an ignition plug comprising an insulator having an axial hole and a center electrode provided in the axial hole, a substantially cylindrical metal shell and one or a plurality of rod-shaped ground electrodes, the manufacturing method comprising: a preparation step of preparing an insulator having a cavity provided at a leading end portion thereof by disposing a leading end of the center electrode more inwards than a leading end of the insulator; a build-in step of building the insulator in an interior of the metal shell in such a manner that the leading end of the insulator is situated closer to a rear end side than the leading end of the metal shell; a removal step of removing at least part of a leading end portion of the metal shell which projects from a leading end face of the insulator; and a welding step of disposing the ground electrode at the leading end portion of the metal shell and welding the ground electrode and the metal shell together after the removal step.

According to the sixth illustrative aspect of the present invention, it becomes possible to manufacture the ignition plug in which the gap between the insulator and the ground electrode is eliminated.

According to a seventh illustrative aspect of the present invention there is provided an ignition plug manufacturing method as set forth in the sixth illustrative aspect of the present invention, further comprising a measuring step of measuring a projecting amount by which the metal shell projects from the leading end face of the insulator prior to the removal step. In the removal step, at least part of the leading end portion of the metal shell is removed a predetermined amount based on the projecting amount so measured. According to this manufacturing method, it becomes possible to bring the leading end face of the metal shell into accurate abutment with the leading end face of the insulator.

According to an eighth illustrative aspect of the present invention, there is provided a manufacturing method for an ignition plug comprising an insulator having an axial hole and a center electrode provided in the axial hole, a substantially cylindrical metal shell and one or a plurality of rod-shaped ground electrodes, the manufacturing method comprising: a ground electrode manufacturing step of manufacturing the ground electrode by joining a noble metal member to a leading end portion of a rod-shaped electrode base material; a preparation step of preparing an insulator having a cavity provided at a leading end portion thereof by disposing a leading end of the center electrode more inwards than a leading end of the insulator; a build-in step of building the insulator in an interior of the metal shell in such a manner that the leading end of the insulator is situated closer to a rear end side than the leading end of the metal shell; a removal step of removing at least part of a leading end portion of the metal shell which projects from a leading end face of the insulator; and a welding step of disposing the ground electrode at the leading end portion of the metal shell and welding the ground electrode and the metal shell together after the removal step.

According to the eighth illustrative aspect of the present invention, it becomes possible to manufacture the ignition plug in which the gap between the insulator and the ground electrode is eliminated. Further, since the noble metal member is joined to the leading end portion of the rod-shaped ground electrode, the durability of the ignition plug can be increased.

According to a ninth illustrative aspect of the present invention, there is provided an ignition plug manufacturing method as set forth in the eighth illustrative aspect of the present invention, further comprising a measuring step of measuring a projecting amount by which the metal shell projects from the leading end face of the insulator prior to the removal step. In the removal step, at least part of the leading end portion of the metal shell is removed a predetermined amount based on the projecting amount so measured. According to this manufacturing method, it becomes possible to bring the leading end face of the metal shell into accurate abutment with the leading end face of the insulator.

According to a tenth illustrative aspect of the present invention, there is provided an ignition plug manufacturing method as set forth in the eighth illustrative aspect or ninth illustrative aspect, wherein in the ground electrode manufacturing step, the noble metal member is joined to the rod-shaped electrode base material by laser welding the noble metal member to the rod-shaped electrode base material from one surface of the rod-shaped electrode base material. In the welding step, the ground electrode and the metal shell are welded together with the one surface of the ground electrode oriented to a side opposite to the leading end portion of the metal shell. According to this manufacturing method, it becomes possible to suppress the generation of a gap between the ground electrode and the insulator which would otherwise be caused by welding marks resulting from the laser welding.

According to an eleventh illustrative aspect of the present invention, there is provided an ignition plug manufacturing method as set forth in any one of the first illustrative aspect to the tenth illustrative aspect, wherein in the build-in step, the metal shell is formed so long in advance to project 0.5 mm or more from the leading end face of the insulator. According to this manufacturing method, since 0.5 mm or more is ensured in advance as the projecting amount of the metal shell, even in the event that the accuracy scatters with which the insulator is built in the metal shell, a cutting margin can be ensured.

According to twelfth illustrative aspect of the present invention, there is provided an ignition plug manufacturing method as set forth in any one of the first illustrative aspect to the eleventh illustrative aspect, wherein in the welding step, the ground electrode and the metal shell are laser welded together. In this way, in the event that the ground electrode and the metal shell are laser welded together, it becomes possible to join the ground electrode and the metal shell together with good accuracy.

In addition, in the ignition plug manufacturing methods that have been described heretofore, in the welding step, the laser welding may be implemented after the ground electrode has been pressed towards the metal shell side. In this way, in the event that the laser welding is implemented after the ground electrode has been pressed towards the metal shell, the separation of the ground electrode from the metal shell can be suppressed which would otherwise be caused by impact generated during laser welding.

Additionally, in the removal step, at least part of the distal portion of the metal shell may be cut from a perpendicular direction to the leading end face of the metal shell. By adopting this manufacturing method, the metal shell can be cut by the use of, for example, a milling machine. In addition, in the removal step, at least part of the leading end portion of the metal shell may be cut from a side of the metal shell. By adopting this manufacturing method, the metal shell can be cut by the use of, for example, a lathe.

Having described the invention, the following is claimed:

1. A method of manufacturing an ignition plug having an insulator with an axial hole, a center electrode provided in the axial hole, a substantially cylindrical metal shell and a plate-shaped ground electrode having a through hole formed in a center thereof, the method comprising:

preparing an insulator having a cavity formed at a leading end portion thereof, said cavity formed by disposing a leading end of the center electrode in the axial hole of the insulator such that the leading end of the center electrode is recessed from a leading end of the insulator;

assembling the insulator in an interior of the metal shell such that the leading end of the insulator is recessed from the leading end of the metal shell;

removing at least part of a leading end portion of the metal shell which projects from a leading end face of the insulator; and disposing the ground electrode at the leading end portion of the metal shell and welding the ground electrode and the metal shell together.

2. The method according to claim 1, further comprising:

measuring a projecting amount by which the metal shell projects from the leading end face of the insulator prior to removing at least part of said leading end portion of the metal shell, wherein a predetermined amount of at least part of the leading end portion of the metal shell is removed based on the measured projecting amount.

3. A method of manufacturing an ignition plug having an insulator with an axial hole, a center electrode provided in the axial hole, a substantially cylindrical metal shell and a plate-shaped ground electrode having a through hole formed in a center thereof, the method comprising:

manufacturing the ground electrode by joining a noble metal member, in which the through hole is formed, to a central portion of a plate-shaped electrode base material;

preparing an insulator having a cavity formed at a leading end portion thereof, said cavity formed by disposing a leading end of the center electrode in the axial hole of the insulator such that the leading end of the center electrode is recessed from a leading end of the insulator;

assembling the insulator in an interior of the metal shell such that the leading end of the insulator is recessed from the leading end of the metal shell;

removing at least part of a leading end portion of the metal shell which projects from a leading end face of the insulator; and disposing the ground electrode at the leading end portion of the metal shell and welding the ground electrode and the metal shell together.

4. The method according to claim 3, further comprising:

measuring a projecting amount by which the metal shell projects from the leading end face of the insulator prior to removing at least part of the leading end portion of the metal shell, wherein a predetermined amount of at least part of the leading end portion of the metal shell is removed based on the measured projecting amount.

5. The method according to claim 3, wherein in the step of manufacturing the ground electrode, the noble metal member is joined to the rod-shaped electrode base material by laser welding the noble metal member to the rod-shaped electrode base material from one surface of the rod-shaped electrode base material, and wherein the ground electrode and the metal shell are welded together with the one surface of the ground electrode oriented to a side opposite to the leading end portion of the metal shell.

6. The method according to claim 4, wherein in the step of manufacturing the ground electrode, the noble metal member is joined to the rod-shaped electrode base material by laser welding the noble metal member to the rod-shaped electrode base material from one surface of the rod-shaped electrode base material, and wherein the ground electrode and the metal shell are welded together with the one surface of the ground electrode oriented to a side opposite to the leading end portion of the metal shell.

7. A method of manufacturing an ignition plug having an insulator with an axial hole, a center electrode provided in the axial hole, a substantially cylindrical metal shell and at least one rod-shaped ground electrode, the method comprising:

preparing an insulator having a cavity formed at a leading end portion thereof, said cavity formed by disposing a leading end of the center electrode in the axial hole of the insulator such that the leading end of the center electrode is recessed from a leading end of the insulator;

assembling the insulator in an interior of the metal shell such that the leading end of the insulator is recessed from the leading end of the metal shell;

removing at least part of a leading end portion of the metal shell which projects from a leading end face of the insulator; and disposing the ground electrode at the leading end portion of the metal shell and welding the ground electrode and the metal shell together.

8. The method according to claim 7, further comprising:

measuring a projecting amount by which the metal shell projects from the leading end face of the insulator prior to removing at least part of the leading end portion of the metal shell, wherein a predetermined amount of at least part of the leading end portion of the metal shell is removed based on the measured projecting amount.

9. A method of manufacturing an ignition plug having an insulator with an axial hole, a center electrode provided in the axial hole, a substantially cylindrical metal shell and at least one rod-shaped ground electrode, the method comprising:

manufacturing the ground electrode by joining a noble metal member to a leading end portion of a rod-shaped electrode base material;

preparing an insulator having a cavity formed at a leading end portion thereof, said cavity formed by disposing a leading end of the center electrode in the axial hole of the insulator such that the leading end of the center electrode is recessed from a leading end of the insulator;

assembling the insulator in an interior of the metal shell such that the leading end of the insulator is recessed from the leading end of the metal shell;

removing at least part of a leading end portion of the metal shell which projects from a leading end face of the insulator; and disposing the ground electrode at the leading end portion of the metal shell and welding the ground electrode and the metal shell together.

10. The method according to claim 9, further comprising:

measuring a projecting amount by which the metal shell projects from the leading end face of the insulator prior to removing at least part of the leading end portion of the metal shell, wherein a predetermined amount of at least part of the leading end portion of the metal shell is removed based on the measured projecting amount.

11. The method according to claim 9, wherein in the step of manufacturing the ground electrode, the noble metal member is joined to the rod-shaped electrode base material by laser welding the noble metal member to the rod-shaped electrode base material from one surface of the rod-shaped electrode base material, and wherein the ground electrode and the metal shell are welded together with the one surface of the ground electrode oriented to a side opposite to the leading end portion of the metal shell.

12. The method according to claim 10, wherein in the step of manufacturing the ground electrode, the noble metal member is joined to the rod-shaped electrode base material by laser welding the noble metal member to the rod-shaped electrode base material from one surface of the rod-shaped electrode base material, and wherein the ground electrode and the metal shell are welded together with the one surface of the ground electrode oriented to a side opposite to the leading end portion of the metal shell.

13. The method according to claim 1, wherein in the assembling step, the metal shell is formed in advance with a length to project 0.5 mm or more from the leading end face of the insulator.

14. The method according to claim 1, wherein the ground electrode and the metal shell are laser welded together.

* * * * *